US011510482B2

(12) United States Patent
Holland et al.

(10) Patent No.: US 11,510,482 B2
(45) Date of Patent: Nov. 29, 2022

(54) LANYARD

(71) Applicant: Kryptek Outdoor Group, LLC, Eagle, ID (US)

(72) Inventors: Kevin Holland, Eagle, ID (US); Joshua Cleghorn, Eagle, ID (US)

(73) Assignee: KRYPTEK OUTDOOR GROUP, LLC, Eagle, ID (US)

( * ) Notice: Subject to any disclaimer, the term of this patent is extended or adjusted under 35 U.S.C. 154(b) by 0 days.

(21) Appl. No.: 17/245,685

(22) Filed: Apr. 30, 2021

(65) Prior Publication Data

US 2021/0337959 A1 Nov. 4, 2021

Related U.S. Application Data

(60) Provisional application No. 63/018,864, filed on May 1, 2020.

(51) Int. Cl.
*A45F 5/00* (2006.01)

(52) U.S. Cl.
CPC ..... *A45F 5/00* (2013.01); *A45F 2005/006* (2013.01)

(58) Field of Classification Search
CPC .. A45F 2005/006; A45F 5/00; Y10T 24/1397; Y10T 24/1368
USPC ..... 224/268
See application file for complete search history.

(56) References Cited

U.S. PATENT DOCUMENTS

| | | | | | |
|---|---|---|---|---|---|
| 4,159,792 | A * | 7/1979 | Siegal | A41D 19/0041 | 224/267 |
| 5,062,344 | A * | 11/1991 | Gerker | D07B 1/185 | 87/8 |
| D402,191 | S * | 12/1998 | Feder | D8/395 | |
| 9,445,659 | B1 * | 9/2016 | Nix | A45F 3/00 | |
| 9,873,005 | B1 * | 1/2018 | Williams | A62B 35/00 | |
| 2011/0309617 | A1 * | 12/2011 | Eley | B65H 69/04 | 289/1.5 |
| 2013/0148295 | A1 * | 6/2013 | Minn | G06F 1/163 | 361/679.59 |
| 2015/0121662 | A1 * | 5/2015 | DeGrouchy | A45F 5/021 | 24/316 |
| 2017/0099932 | A1 * | 4/2017 | Mather | A45F 3/047 | |
| 2017/0146313 | A1 * | 5/2017 | Briody | E05B 67/383 | |

* cited by examiner

*Primary Examiner* — Adam J Waggenspack
(74) *Attorney, Agent, or Firm* — K&L Gates LLP

(57) ABSTRACT

A lanyard device includes a first attachment loop, a central portion, and a second attachment loop. Each of the first attachment loop and the second attachment loop is coupled to the central portion. The first attachment loop has a fixed diameter. The second attachment loop has an adjustable diameter. In an embodiment, the second attachment loop terminates at an adjustment feature, which is coupled to the central portion. For example, the adjustment feature may be a Prusik knot.

16 Claims, 4 Drawing Sheets

LANYARD

PRIORITY CLAIM

This application claims priority to U.S. Provisional Patent Application No. 63/018,864 entitled LANYARD, filed on May 1, 2020, the entire contents of which are incorporated by reference herein and relied upon.

BACKGROUND

Military, police, and other emergency services personnel are often required to carry additional equipment, bags, and the like. This additional equipment is typically "attached" to the user or, alternatively, attached to a mode of transportation such as a vehicle, helicopter, or airplane. Commonly, bungee cords are used to fasten equipment to the user or to the mode of transportation. For example, the bungee cord permits easy attachment and removal of both the equipment and the cord itself. Among other reasons, bungee cords are desirable for their ability to change length by stretching.

However, bungee cords are often flimsy, lacking elastic rigidity. Moreover, often bungee cords may easily detach (e.g., unhook) from various points of attachment. This is especially concerning in high-risk situations, such as those encountered by military personnel. While bungee cords are flexible, they do not afford the user with an ability to adjust the length of the cord to a desired length; bungee cords have unstretched/stretched lengths, but the user cannot adjust the overall unstretched/stretched length for customization on an application-by-application basis. While ropes provide for fixed length applications, rope length cannot be easily adjusted without significant untying/retying of knots.

Improved devices and systems for attaching equipment and personnel are therefore needed.

SUMMARY

To improve on the existing attachment paradigm, new devices and systems for attaching equipment with an adjustable lanyard are provided herein. More specifically, the lanyards disclosed herein are dual loop lanyards, with a loop at each end. These loops are configured for attachment to equipment, to users, such as military personnel, and to modes of transportation, such as military vehicles, helicopters, or other related modes of transportation. The loops at each end of the lanyard are closed loops, such that the lanyard will not inadvertently detach from a particular point of attachment.

Importantly, the lanyard itself including the size of a loop and the overall length of the lanyard are adjustable. More specifically, the lanyard may include a Prusik knot (or other related type of friction hitch), such that the diameter of at least one of the two loops is adjustable. In this way, the overall length of the lanyard is adjustable. For example, increasing the size or diameter of a loop results in an overall decrease of the lanyard's total length. The adjustable length lanyards disclosed herein afford the user with an additional degree of control and customization with respect to the attachment of equipment.

In light of the disclosure herein, and without limiting the scope of the invention in any way, in a first aspect of the present disclosure, which may be combined with any other aspect listed herein unless specified otherwise, a lanyard device includes a first attachment loop, a central portion, and a second attachment loop. Each of the first attachment loop and the second attachment loop is coupled to the central portion. The first attachment loop has a fixed diameter. The second attachment loop has an adjustable diameter.

In a second aspect of the present disclosure, which may be combined with any other aspect listed herein unless specified otherwise, the second attachment loop terminates at an adjustment feature, which is coupled to the central portion.

In a third aspect of the present disclosure, which may be combined with any other aspect listed herein unless specified otherwise, the adjustment feature is wrapped around the central portion.

In a fourth aspect of the present disclosure, which may be combined with any other aspect listed herein unless specified otherwise, a diameter of the adjustment feature is smaller than a diameter of the central portion.

In a fifth aspect of the present disclosure, which may be combined with any other aspect listed herein unless specified otherwise, the adjustment feature is a Prusik knot.

In a sixth aspect of the present disclosure, which may be combined with any other aspect listed herein unless specified otherwise, each of the first attachment loop, the second attachment loop, and the central portion, are formed by a single rope or cable.

In a seventh aspect of the present disclosure, which may be combined with any other aspect listed herein unless specified otherwise, the single rope is constructed of one of ultra-high molecular weight polyethylene and high modulus polyethylene.

In an eighth aspect of the present disclosure, which may be combined with any other aspect listed herein unless specified otherwise, each of the first attachment loop and the second attachment loop include shackles.

In a ninth aspect of the present disclosure, which may be combined with any other aspect listed herein unless specified otherwise, the first attachment loop includes a snap shackle.

In a tenth aspect of the present disclosure, which may be combined with any other aspect listed herein unless specified otherwise, the second attachment loop includes a Tudor snap hook.

In an eleventh aspect of the present disclosure, which may be combined with any other aspect listed herein unless specified otherwise, the first attachment loop terminates in a stitching sleeve.

In a twelfth aspect of the present disclosure, which may be combined with any other aspect listed herein unless specified otherwise, two segments of the first attachment loop are sewn together at the stitching sleeve.

In a thirteenth aspect of the present disclosure, which may be combined with any other aspect listed herein unless specified otherwise, two segments of the first attachment loop are spliced together at the stitching sleeve.

In a fourteenth aspect of the present disclosure, which may be combined with any other aspect listed herein unless specified otherwise, a lanyard device includes a first attachment loop, a central portion, and a second attachment loop. Each of the first attachment loop and the second attachment loop is coupled to the central portion. The second attachment loop terminates at a Prusik knot, which is coupled to the central portion.

In a fifteenth aspect of the present disclosure, which may be combined with any other aspect listed herein unless specified otherwise, each of the first attachment loop, the second attachment loop, and the central portion, are formed by a single rope or cable.

In a sixteenth aspect of the present disclosure, which may be combined with any other aspect listed herein unless specified otherwise, the single rope is constructed of one of ultra-high molecular weight polyethylene and high modulus polyethylene.

In a seventeenth aspect of the present disclosure, which may be combined with any other aspect listed herein unless specified otherwise, the first attachment loop has a fixed diameter, and wherein the second attachment loop has an adjustable diameter.

In an eighteenth aspect of the present disclosure, which may be combined with any other aspect listed herein unless specified otherwise, the Prusik knot is wrapped around the central portion.

In a nineteenth aspect of the present disclosure, which may be combined with any other aspect listed herein unless specified otherwise, a diameter of the Prusik knot is smaller than a diameter of the central portion.

In a twentieth aspect of the present disclosure, which may be combined with any other aspect listed herein unless specified otherwise, each of the first attachment loop and the second attachment loop include shackles.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
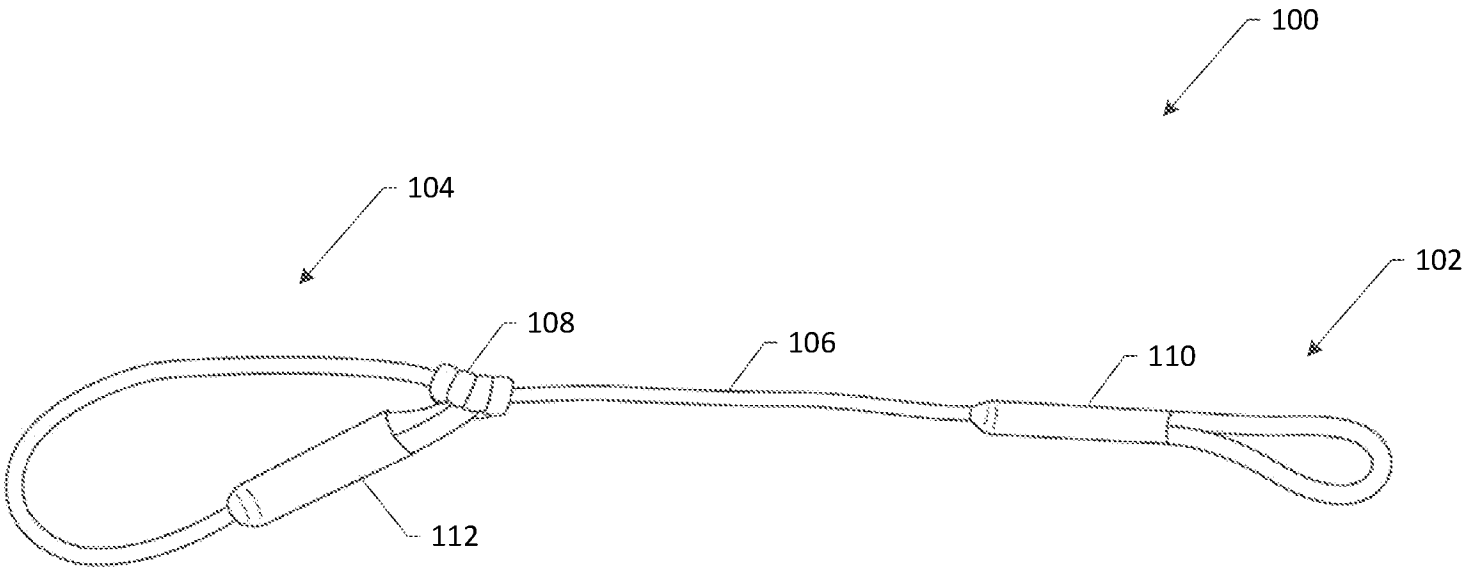
FIG. 1 is a perspective-side view of a lanyard device, according to an example embodiment of the present disclosure.

Referring now to the drawings, FIG. 1 illustrates an adjustable lanyard 100. Lanyard 100 includes multiple attachment points, including at least a first attachment loop 102 and a second attachment loop 104. A central portion 106 is disposed between the first attachment loop 102 and the second attachment loop 104. For example, each of the first attachment loop 102 and the second attachment loop 104 are coupled to the central portion 106. In an embodiment, each of the first attachment loop 102, the second attachment loop 104, and the central portion 106, are formed by a single piece of material, such as a single strand of rope or cable. For example, the single strand of rope is one of ultra-high molecular weight polyethylene and high modulus polyethylene. Other related rope materials are, likewise, contemplated herein.

In an embodiment, the first attachment loop 102, the second attachment loop 104, and the central portion 106 are comprised of an abrasion resistant rope. In a preferred embodiment, the first attachment loop 102, the second attachment loop 104, and the central portion 106 are comprised of a 6 mm diameter Kevlar rope. It should be appreciated, however, that additional or alternative materials and dimensions are contemplated herein.

It should be appreciated that the lanyard 100 is adjustable. In this sense, at least one of the attachment loops 102, 104 is adjustable. For example, as illustrated in FIG. 1, the first attachment loop 102 has a fixed diameter; by comparison, the second attachment loop 104 has an adjustable diameter. Specifically, adjustment feature 108 is configured to translate along central portion 106 to increase or decrease the size or diameter of attachment loop 104. Because second attachment loop 104 has an adjustable diameter, the overall length of lanyard 100 is adjustable. For example, increasing the size of second attachment loop 104 (e.g., by translating adjustment feature 108 to the right as illustrated in FIG. 1) decreases the overall length of lanyard 100; decreasing the size of second attachment loop 104 (e.g., by translating adjustment feature 108 to the left as illustrated in FIG. 1) increases the overall length of lanyard 100. In an embodiment, the maximum length of lanyard 100 is 30 inches. It should be appreciated that, in an alternative embodiment, the first attachment loop 102 has the adjustable diameter and the second attachment loop 104 has the fixed diameter (e.g., implementing adjustment feature 108 with first attachment loop 102). Furthermore, in another alternative embodiment, both of the first attachment loop 102 and the second attachment loop 104 have adjustable diameters (e.g., implementing one adjustment feature 108 for each of first attachment loop 102 and second attachment loop 104).

Continuing on with the embodiment illustrated by FIG. 1, the second attachment loop 104 terminates at an adjustment feature 108. For example, a terminal end of second attachment loop 104 may include the adjustment feature 108. Adjustment feature 108 is coupled to central portion 106 of lanyard 100. In an embodiment, adjustment feature 108 is a rope or cable, wrapped around a segment of central portion 106.

Adjustment feature 108 is generally configured to be coupled to central portion 106, such that adjustment feature 108 may be selectively fixed (e.g., unable to slide relative to central portion 106) and unfixed (e.g., capable of sliding relative to central portion 106). In an embodiment, adjustment feature 108 is a rope having a diameter that is smaller than a diameter of rope associated with the central portion 106. In a related embodiment, adjustment feature 106 is a rope having a diameter that is smaller than the diameter of rope associated with each of the first attachment loop 102, the second attachment loop 104, and the central portion 106.

Figure 2:
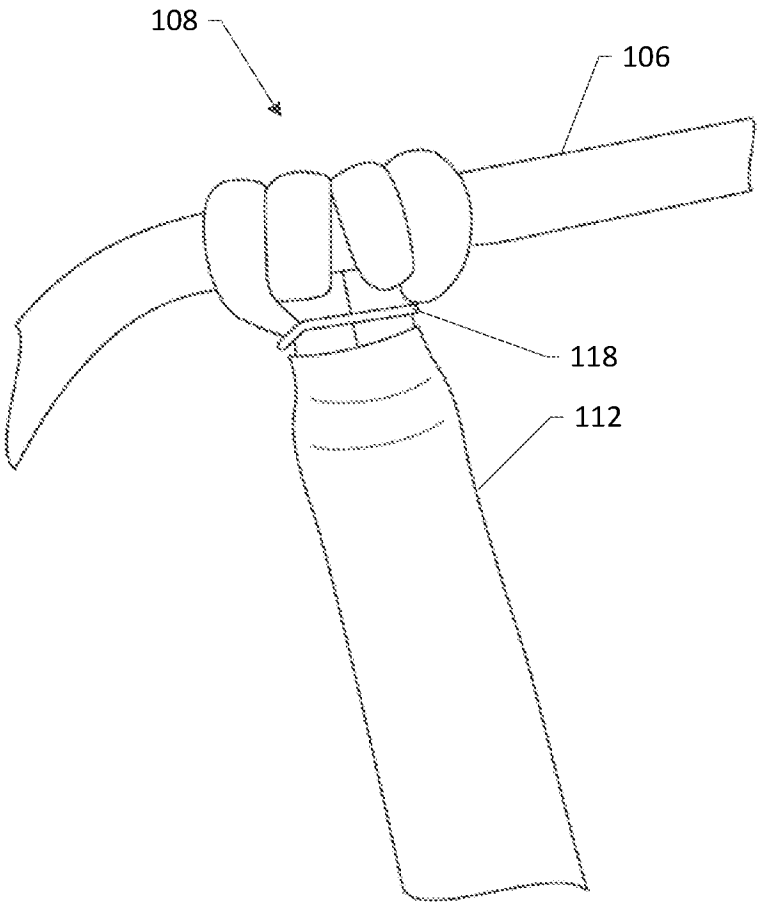
FIG. 2 is a front-view of a Prusik knot, according to an example embodiment of the present disclosure.
Figure 3:
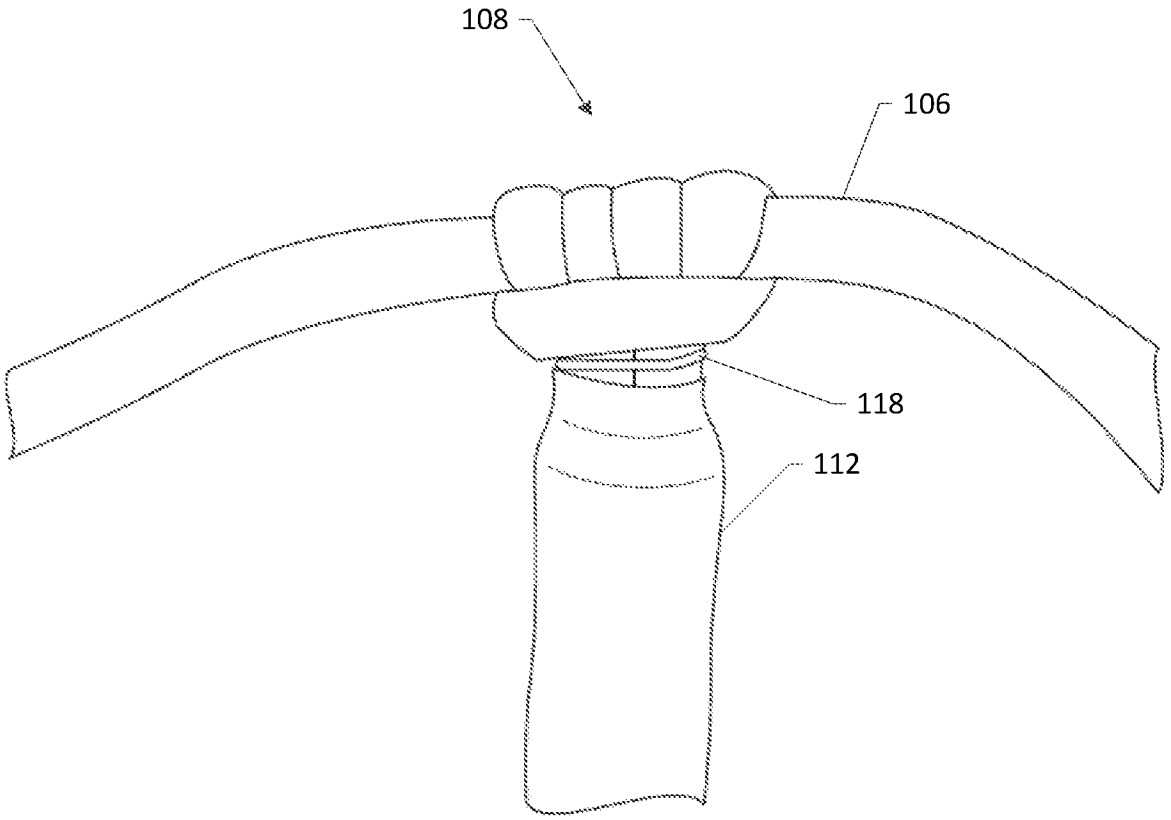
FIG. 3 is a rear-view of a Prusik knot, according to an example embodiment of the present disclosure.

As illustrated by FIGS. 2 and 3, in an embodiment, adjustment feature 108 is a Prusik knot or other friction hitch. In a particular example embodiment, adjustment feature 108 implements a Prusik knot with a girth hitch. It should be appreciated that other similar knots and hitches are contemplated herein. In an embodiment, second attachment loop 104 and adjustment feature 108 are comprised of the same strand of rope; in this particular embodiment, the diameter of second attachment loop 104 is reduced at its terminal end and the portion of rope with the reduced diameter constitutes adjustment feature 108. In a different embodiment, second loop 104 terminates at an end of rope; adjustment feature 108 extends from the terminal end of second loop 104, as a separate rope having a smaller cross-sectional diameter than that of the second loop 104.

In an embodiment, lanyard 100 includes a bull ring 118, disposed adjacent to adjustment feature 108. For example, bull ring 118 may be a piece of crimped metal. In an embodiment, bull ring 118 is configured to fix the total amount of rope associated with adjustment feature 108, to prevent adjustment feature 108 from becoming undesirably loose or detached from central portion 106.

Returning now to FIG. 1, lanyard 100 further includes first wrap 110 and second wrap 112. For example, first wrap 110 is configured to cover any stitching associated with first attachment loop 102, given first attachment loop 102 has a fixed diameter. In an embodiment, first wrap 110 is a heat-shrink wrap. In an embodiment, two segments of first attachment loop 102 are sewn together underneath first wrap 110; in a related embodiment, two segments of first attachment loop 102 are sewn together with first wrap 110, such that first wrap serves as a barrier or scaffold. For example, when stitched together, the two segments of first attachment loop 102 have a 3,000 lb. strength rating at the stitching. In a different embodiment, two segments of first attachment loop are spliced together, underneath first wrap 110.

Similarly, for example, second wrap 112 is configured to cover the terminal end of second attachment loop 104. Second wrap 112 may additionally be configured to retain a portion of adjustment feature 108, such as excess rope or cable that may exist when first attachment loop 104 is reduced to a smaller diameter. For example, a terminal end of adjustment feature 108 may slide within second wrap 112. In an embodiment, second wrap 112 is a heat-shrink wrap. In an embodiment, second attachment loop 104 terminates at second wrap 112 and adjustment feature 108 extends from second wrap. In a different embodiment, adjustment feature 108 may be coupled to a terminal end of the second attachment loop 104 (e.g., via another loop, spliced at the terminal end of second attachment loop 104). In a related embodiment, adjustment feature 108 is a hollow block core-less rope with a hitch-end (e.g., for coupling with a segment of central portion 106) and a looped-end (e.g., for coupling with the terminal end of second attachment loop 104).

As noted previously, adjustable lanyards, such as lanyard 100, afford the user with an additional degree of control and customization with respect to attaching various equipment, personnel, and the like. For example, in a use-case, lanyard 100 is attached to a military vehicle, helicopter or other mode of transportation (referred to herein generally as vehicle). More particularly, the first attachment loop 102 is fixedly attached to the military vehicle. Necessary equipment is attached to the second attachment loop 104; because lanyard 100 is adjustable via adjustment feature 108, distance between the necessary equipment and the attachment point on the vehicle is controllable by the user. It should be appreciated that the second attachment loop 104 could be fixedly attached to the vehicle, such that equipment is attached to the first attachment loop 102. Alternatively, both of the first attachment loop 102 and the second attachment loop 104 could be fixedly attached to the military vehicle. In this embodiment, lanyard 100 operates as an adjustable strap for holding equipment to the military vehicle.

Figure 4:
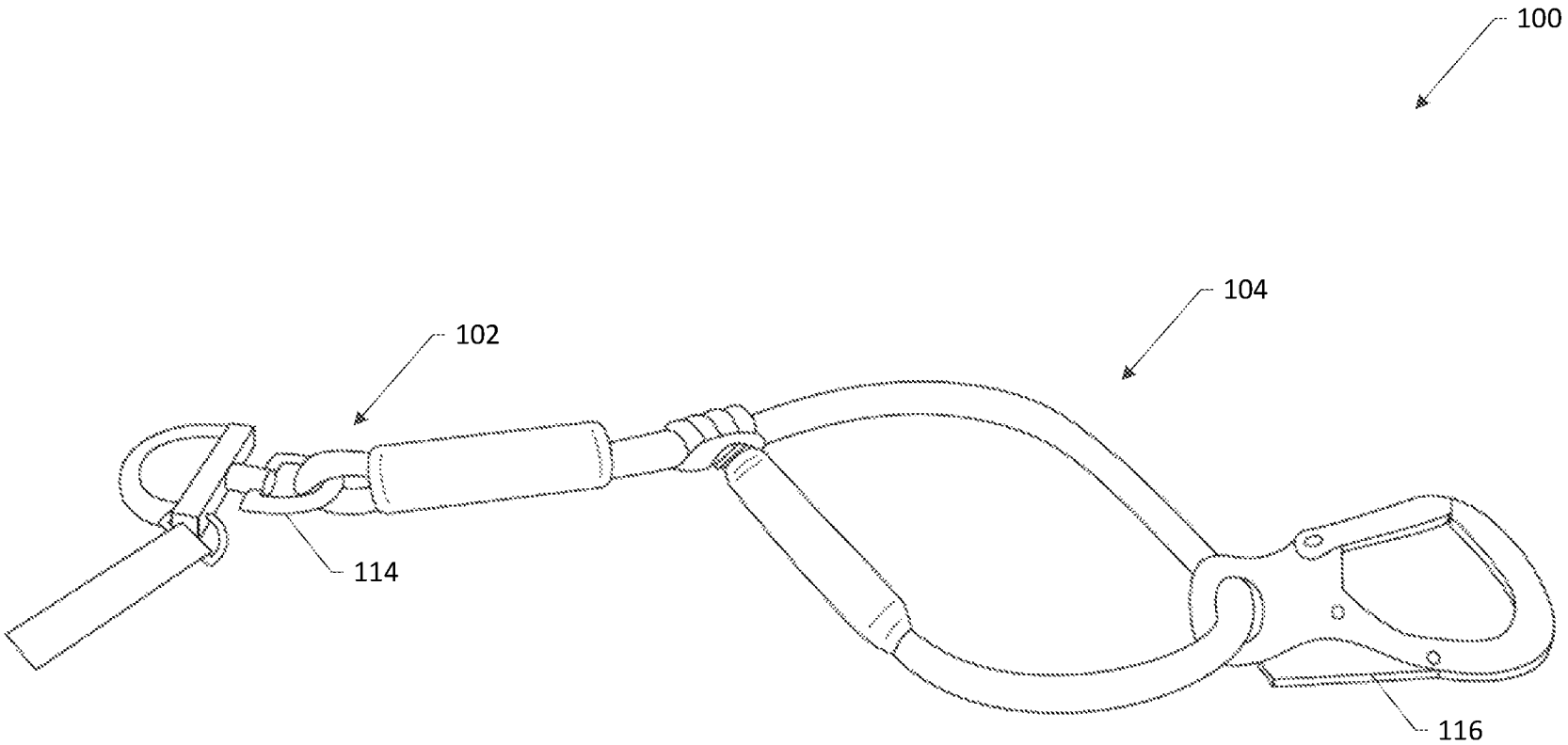
FIG. 4 is a perspective-side view of a lanyard device with shackles, according to an example embodiment of the present disclosure.

It should be appreciated that lanyard 100 may include additional hardware for attaching purposes. For example, with reference to FIG. 4, lanyard 100 may include a first shackle 114 coupled to first attachment loop 102 and a second shackle 116 coupled to second attachment loop 104. In a particular embodiment, first shackle 114 is a snap shackle. For example, first shackle 114 has a 4,000 lb. strength rating. In a particular embodiment, second shackle 116 is a TUDOR™ snap hook. For example, second shackle 116 has a 7,300 lb. strength rating. Beyond the specific shackles illustrated in FIG. 4, it should be appreciated that first shackle 114 and second shackle 116 may, in alternative embodiments, include hooks, clips, locking carabineers, or other similar attachment features for attaching equipment to lanyard 100 and attaching lanyard 100 to other surfaces such as vehicles.

In another use case, lanyard 100 is attached to a military personnel's kit, such as belt or nick sack. More particularly, the first attachment loop 102 is fixedly attached to the military kit. Necessary equipment is attached to the second attachment loop 104; because lanyard 100 is adjustable via adjustment feature 108, distance between the necessary equipment and the attachment point on the kit is controllable and customizable by the user. It should be appreciated that the second attachment loop 104 could be fixedly attached to the kit, such that equipment is attached to the first attachment loop 102. Alternatively, both of the first attachment loop 102 and the second attachment loop 104 could be fixedly attached to the military kit. In this embodiment, lanyard 100 operates as an adjustable strap for holding equipment to the military kit.

While the use cases above describe several modes of using lanyard 100, it should be appreciated that lanyard 100 may be implemented in any situations or circumstances where adjustable length fastening and attachment is required.

As used in this specification, including the claims, the term "and/or" is a conjunction that is either inclusive or exclusive. Accordingly, the term "and/or" either signifies the presence of two or more things in a group or signifies that one selection may be made from a group of alternatives.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated. Note that elements recited in means-plus-function format are intended to be construed in accordance with 35 U.S.C. § 112 ¶6. The scope of the invention is therefore defined by the following claims.

The invention is claimed as follows:

1. A lanyard device comprising:

a first attachment loop;

a central portion; and a second attachment loop, wherein each of the first attachment loop and the second attachment loop is coupled to the central portion, wherein each of the first attachment loop, the second attachment loop, and the central portion are formed by a single rope or cable;

wherein the first attachment loop has a fixed diameter, wherein the second attachment loop has an adjustable diameter, and comprises a reduced cross-sectional diameter portion of the single rope or cable along an adjustment feature that is wrapped around the central portion.

2. The lanyard device of claim 1, wherein a diameter of the adjustment feature is smaller than a diameter of the central portion.

3. The lanyard device of claim 1, wherein the adjustment feature is a Prusik knot.

4. The lanyard device of claim 1, wherein the single rope is constructed of one of ultra-high molecular weight polyethylene and high modulus polyethylene.

5. The lanyard device of claim 1, wherein each of the first attachment loop and the second attachment loop include shackles.

6. The lanyard device of claim 5, wherein the first attachment loop includes a snap shackle.

7. The lanyard device of claim 6, wherein the second attachment loop includes a snap hook.

8. The lanyard device of claim 1, wherein the first attachment loop terminates in a stitching sleeve.

9. The lanyard device of claim 8, wherein two segments of the first attachment loop are sewn together at the stitching sleeve.

10. The lanyard device of claim 8, wherein two segments of the first attachment loop are spliced together at the stitching sleeve.

11. The lanyard device of claim 8, further comprising:

a wrap to cover a terminal end of the single rope or cable along the second attachment loop; and a bull ring between the wrap and the adjustment feature, wherein the bull ring is configured to fix a length of the single rope or cable within the adjustment feature.

12. A lanyard device comprising:

a first attachment loop;

a central portion; and a second attachment loop, wherein each of the first attachment loop and the second attachment loop is coupled to the central portion, wherein each of the first attachment loop, the second attachment loop, and the central portion are formed by a single rope or cable;

wherein the second attachment loop terminates at a Prusik knot, which is coupled to the central portion, and wherein the Prusik knot comprising a reduced cross-sectional diameter portion of the single rope or cable.

13. The lanyard device of claim 12, wherein the single rope is constructed of one of ultra-high molecular weight polyethylene and high modulus polyethylene.

14. The lanyard device of claim 12, wherein the first attachment loop has a fixed diameter, and wherein the second attachment loop has an adjustable diameter.

15. The lanyard device of claim 12, wherein each of the first attachment loop and the second attachment loop include shackles.

16. The lanyard device of claim 12, further comprising:

a wrap to cover a terminal end of the single rope or cable along the second attachment loop; and a bull ring between the wrap and the Prusik knot, wherein the bull ring is configured to fix a length of the single rope or cable within the Prusik knot.

* * * * *